US006748630B2

(12) United States Patent
Livingston

(10) Patent No.: US 6,748,630 B2
(45) Date of Patent: Jun. 15, 2004

(54) RATCHET-TYPE BUCKLE AND SNOWBOARD BINDING

(75) Inventor: David Livingston, Pennsburg, PA (US)

(73) Assignee: K-2 Corporation, Vashon, WA (US)

( * ) Notice: Subject to any disclaimer, the term of this patent is extended or adjusted under 35 U.S.C. 154(b) by 0 days.

(21) Appl. No.: 10/220,182

(22) PCT Filed: May 31, 2001

(86) PCT No.: PCT/US01/17796

§ 371 (c)(1),
(2), (4) Date: Aug. 27, 2002

(87) PCT Pub. No.: WO01/91862

PCT Pub. Date: Dec. 6, 2001

(65) Prior Publication Data

US 2003/0019081 A1 Jan. 30, 2003

Related U.S. Application Data

(60) Provisional application No. 60/208,136, filed on May 31, 2000.

(51) Int. Cl.[7] ..... A43C 11/14; A43B 11/00; A44B 21/00

(52) U.S. Cl. ..... 24/68 SK; 24/68 R; 24/70 SK; 24/71 SK; 24/712.1; 36/50.1

(58) Field of Search ..... 24/68 SK, 68 R, 24/68 A, 68 B, 70 SK, 71 SK, 712.1, 713, 69 SK; 36/50.1, 50.5, 117

(56) References Cited

U.S. PATENT DOCUMENTS

| | | | | |
|---|---|---|---|---|
| 3,662,435 A | | 5/1972 | Allsop | |
| 4,326,320 A | | 4/1982 | Riedel | |
| 4,547,980 A | | 10/1985 | Olivieri | |
| 4,667,424 A | | 5/1987 | Sartor et al. | |
| 4,727,627 A | | 3/1988 | Baggio et al. | |
| 4,860,606 A | * | 8/1989 | Rousseau | 24/68 R |
| 5,416,952 A | | 5/1995 | Dodge | |
| 5,426,826 A | | 6/1995 | Takimoto | |
| 5,606,779 A | | 3/1997 | Lu | |
| 5,745,959 A | | 5/1998 | Dodge | |
| 5,745,963 A | | 5/1998 | Graziano | |
| 5,779,259 A | | 7/1998 | Lin | |
| 5,887,318 A | * | 3/1999 | Nicoletti | 24/71 SK |
| 5,909,850 A | | 6/1999 | Cavasin et al. | |
| 5,927,744 A | | 7/1999 | Knapschafer | |
| 6,175,994 B1 | * | 1/2001 | Nicoletti | 24/68 SK |

FOREIGN PATENT DOCUMENTS

EP 0 787 442 A1 8/1997

* cited by examiner

*Primary Examiner*—Victor Sakran
(74) *Attorney, Agent, or Firm*—Christensen O'Connor Johnson Kindness PLLC

(57) ABSTRACT

A ratchet-type buckle (100) is disclosed for use with a ladder strap (80), wherein the buckle includes a toothed, barrel-shaped strap engagement member (140) that is rotatably mounted between oppositely disposed sidewalls (130) that are pivotally coupled to a base (110). The engagement member is positioned to drivably engage and hold the strap. A holding pawl (160) allows forward rotation and hinders backward rotation of the engagement member. A driving pawl (180) is incorporated into a lever assembly (170), which is pivotally coupled to the sidewalls, the driving pawl positioned to engage and rotate the engagement member teeth when the lever assembly is pivoted in a forward direction. The pivotal coupling of the sidewalls to the base permit the engagement member to be lifted away from the base, to release the strap. The sidewalls are preferably biased towards the base.

18 Claims, 6 Drawing Sheets

RATCHET-TYPE BUCKLE AND SNOWBOARD BINDING

CROSS-REFERENCES TO RELATED APPLICATIONS

This application is a U.S. national phase application filed under 35 U.S.C. §371 and based on International Patent Application No. PCT/US01/17796, filed May 31, 2001, which international application claims the benefit of the filing of U.S. Provisional Patent Application No. 60/208,136, entitled Ratchet-Type Buckle, filed on May 31, 2000, and the specification thereof is incorporated herein by reference.

FIELD OF THE INVENTION

This invention relates to bindings used for sports equipment and, more particularly, to ratchet-type buckles used in such bindings.

BACKGROUND OF THE INVENTION

In many sports, for example, winter sports such as snowboarding and skiing, users bind their boots to a sporting apparatus such as a pair of skis or a snowboard. Conventional snowboard bindings are generally classified as either high back bindings or plate or step-in bindings. In such bindings, it is generally desirable to have a comfortable and secure attachment to the apparatus that is easily engaged and disengaged. Although the present invention will clearly have applications in fields other than snowboarding, including, in particular, other sports equipment applications, the present ratchet design was originally developed for snowboard binding applications; and for purposes of disclosing and teaching the operation of the invention, the ratchet will therefore be described with reference to snowboard bindings.

In snowboarding especially, a tight and secure binding of the boots to the snowboard is important. If there is too much slack or play in the binding attaching the snowboarder to the snowboard, then the snowboarder will not be able to control the snowboard as precisely as is desired. A snowboarder's boot is held to the snowboard in a binding. Most snowboard bindings utilize a cradle that is bolted to the top of the board that receives the snowboarder's boot. Typically, two straps extend around the top of the boot—one at the instep and the second at the toe—to secure the boot to the snowboard. Unlike ski bindings, the snowboard boot binding generally will not release the boot from the binding during a fall. In fact, it is generally desirable that the binding straps hold the boot securely enough that the boot cannot inadvertently slip out of the binding, even if the snowboarder falls during a run.

Many types of snowboard bindings have been developed to secure the snowboarder's boots to the snowboard. Because of the importance of a tight coupling between the snowboard boots and the snowboard, buckles for snowboard bindings frequently include tightening devices that provide some mechanical advantage to facilitate strap tightening. For example, various strap designs have been developed that utilize a ratchet-type buckle that mounts to a first binding element, such as an instep pad, and a second binding element or strap having a plurality of transverse ridges, or teeth, often referred to as a ladder strap.

In prior art ratchet buckles, a lever having a plurality of teeth on one end is pivotally mounted to a buckle body that slidably receives the ladder strap. Such ratchet buckles are disclosed, for example, by Dodge in U.S. Pat. Nos. 5,416,952 and 5,745,959, and by Allsop in U.S. Pat. No. 3,662,435. The ladder strap is inserted into the buckle body and the lever is pivoted to engage the strap teeth and advance the strap. A separate holding device (i.e., a pawl) is provided to engage the strap teeth and prevent backward movement of the strap as the lever is lifted away from the strap and returned to the start position, to re-engage the strap, and be re-pivoted to further tighten the strap, as necessary. A disadvantage of such prior art ratchet buckles is that they engage and disengage the strap teeth multiple times during the tightening process, which generates wear and tear on the ladder strap, which is typically made from a softer material. Multiple engagements and disengagements of the strap also increase the likelihood that the device will slip during tightening, either due to misalignment of the mechanisms with the strap, wear and tear on the strap or buckle, or due to foreign matter such as dirt and ice interfering with a proper engagement. Another disadvantage to such devices is that the toothed driving end of the lever is typically disposed a distance from the holding device, so that the strap must be inserted a fair distance into the strap to engage both the lever and the holding device before the lever will operate to tighten the strap.

Other ratchet-type buckles have been developed that utilize a plurality of spring-loaded pawls that alternately drive (tighten) and hold the ladder strap. Such a buckle is disclosed, for example, by Lin in U.S. Pat. No. 5,779,259. The buckle taught by Lin, however, has the same disadvantages identified above. Multiple engagements and disengagements of the ladder strap will increase wear on the strap, and both of the longitudinally spaced-apart pawls must be engaged by the strap for the device to operate properly.

Another ratchet buckle mechanism is disclosed by Olivieri in U.S. Pat. No. 4,547,980, which teaches a device having a rotatable sprocket that engages transverse teeth on a ladder strap. In Olivieri, the sprocket is rotatably mounted to the buckle, which is prevented from rotating in one direction by a spring-loaded holding pawl. A driving pawl is provided on a pivotable lever, which is pivoted to rotatably drive the sprocket and tighten the strap. However, the device disclosed by Olivieri has no apparent means to release the strap. Although the inventor states that to release the strap it suffices to depress the back end of the driving pawl, the disclosed action would not release the locking pawl, and therefore the strap will not be released. It appears that to release the strap the user must press the driving pawl and pull back the holding pawl, which may be very difficult, particularly if the user must simultaneously pull on the ladder strap. Moreover, the sprocket will still engage the strap, and will therefore rotate as the strap is pulled out, which increases wear on the buckle and strap.

There remains a need for a ratchet buckle for use with a ladder-type strap that minimizes wear and tear on the strap and is easily releasable.

SUMMARY OF THE INVENTION

The present invention is directed to a buckle for engaging a ladder strap that provides a ratchet mechanism that facilitates tightening the strap, and that relatively easily releases the strap. The ratchet-type buckle includes a base the receives the strap, a pair of oppositely disposed sidewalls, and a strap engagement member rotatably mounted to the sidewalls. The strap engagement member is movable between a first and a second position, and includes a plurality of teeth that drivably engage the teeth of the strap when the strap engagement member is in the first position. A holding pawl permits forward rotation of the strap engagement member, and interferes with backward rotation of the strap engagement member. A lever assembly includes a driving pawl that drivably engages the strap engagement member to rotate the strap engagement member and tighten the strap.

In an aspect of the present invention the holding pawl is biased towards the strap engagement member.

In an embodiment of the present invention the sidewalls are pivotally attached to the base, the pivotable sidewalls accommodating movement of the strap engagement member between the first and second positions, and the sidewalls are biased towards the strap engagement member first position.

In an embodiment of the present invention the strap engagement mechanism comprises a generally cylindrical barrel having a plurality of outwardly disposed longitudinal teeth that are spaced to engage the teeth on the ladder strap.

In an embodiment of the present invention the strap assembly includes left and right link members that are pivotally attached to the strap engagement member and a lever body pivotally attached to the link members, wherein the forward portion of the lever body is the driving pawl that drivably engages the strap engagement member.

In another embodiment of the present invention the lever assembly is of unitary construction and includes a central driving pawl portion.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
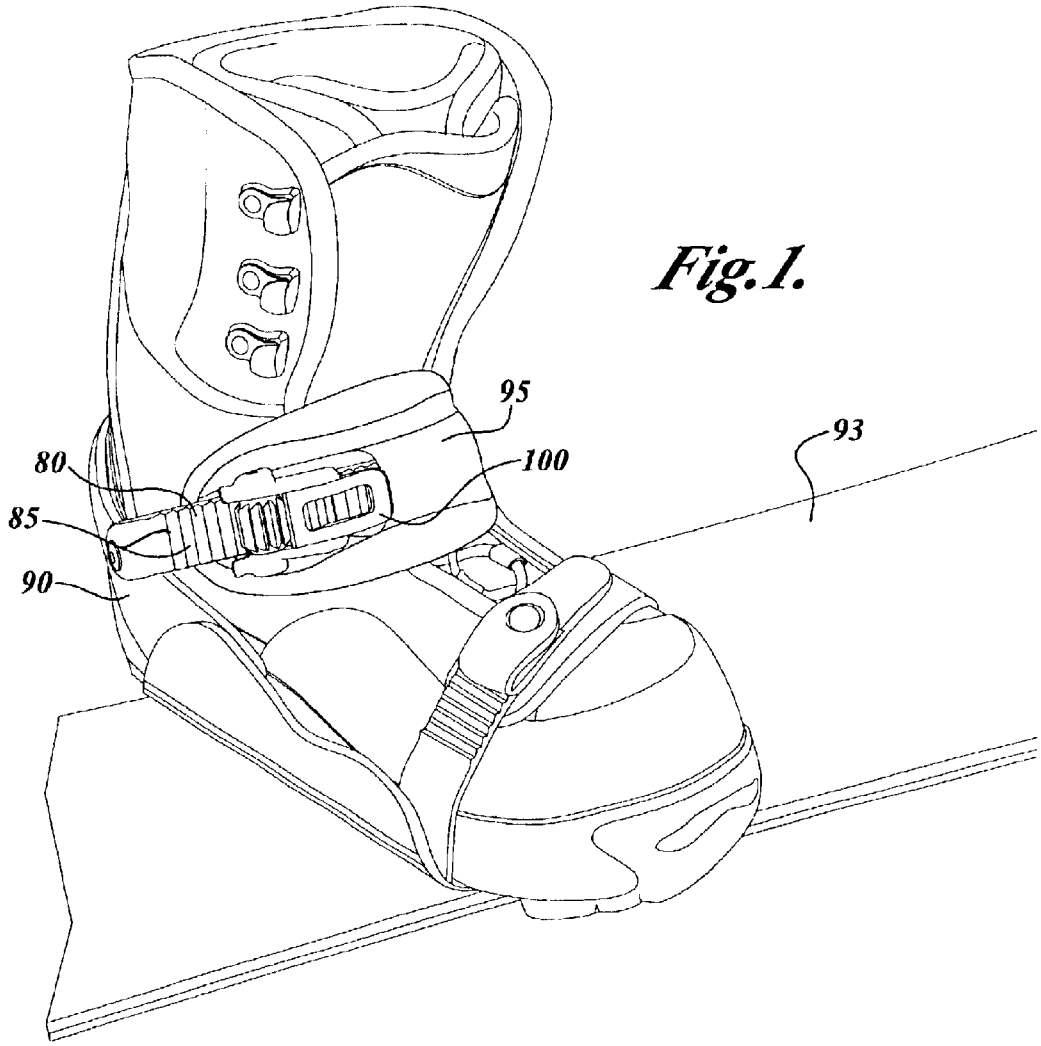
FIG. 1 shows a perspective view of a buckle according to the present invention, attached to a snowboard binding for attaching a snowboard boot to a snowboard.

Referring now to FIG. 1, a buckle 100 according to the present invention is shown attached to an instep pad 95 for a snowboard binding 90 mounted on a snowboard 93. The instep pad 95 includes a strap that couples the buckle 100 to the medial side of a binding frame. The buckle 100 engages a ladder-type strap 80, having a plurality of saw-tooth shaped transverse teeth or protrusions 85. The ladder-type strap 80 is coupled to the lateral side of the binding frame. The frame is secured to a snowboard, and receives the snowboard boot between lateral and medial sides thereof. Such ladder straps are frequently used in a number of applications, including for closing and attaching sporting footwear. It will be appreciated that although saw-tooth shaped teeth are disclosed and preferred for the present invention, other strap-tooth shapes are also possible, including, for example, generally rectangular teeth and symmetrically triangular teeth.

Figure 2:
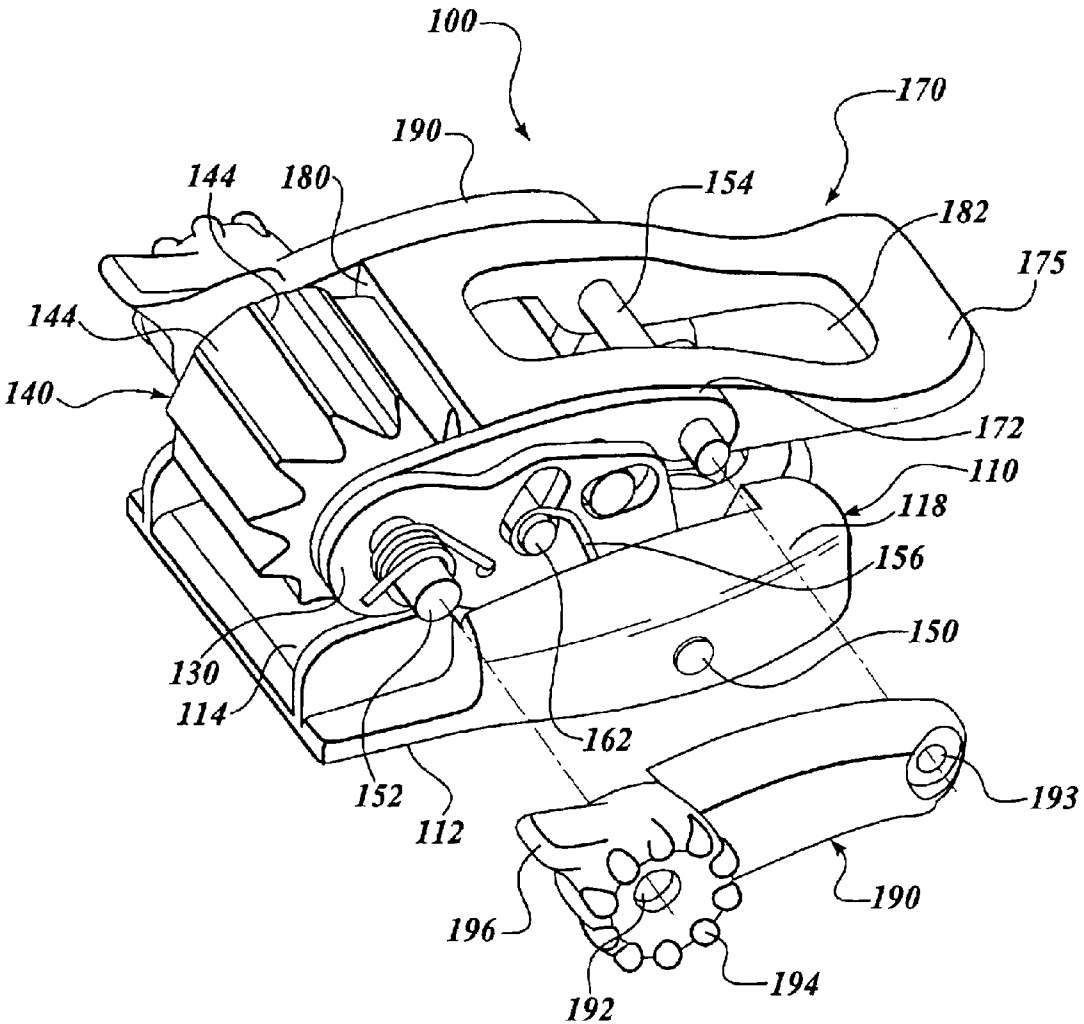
FIG. 2 is a perspective view of the buckle shown in FIG. 1.
Figure 3:
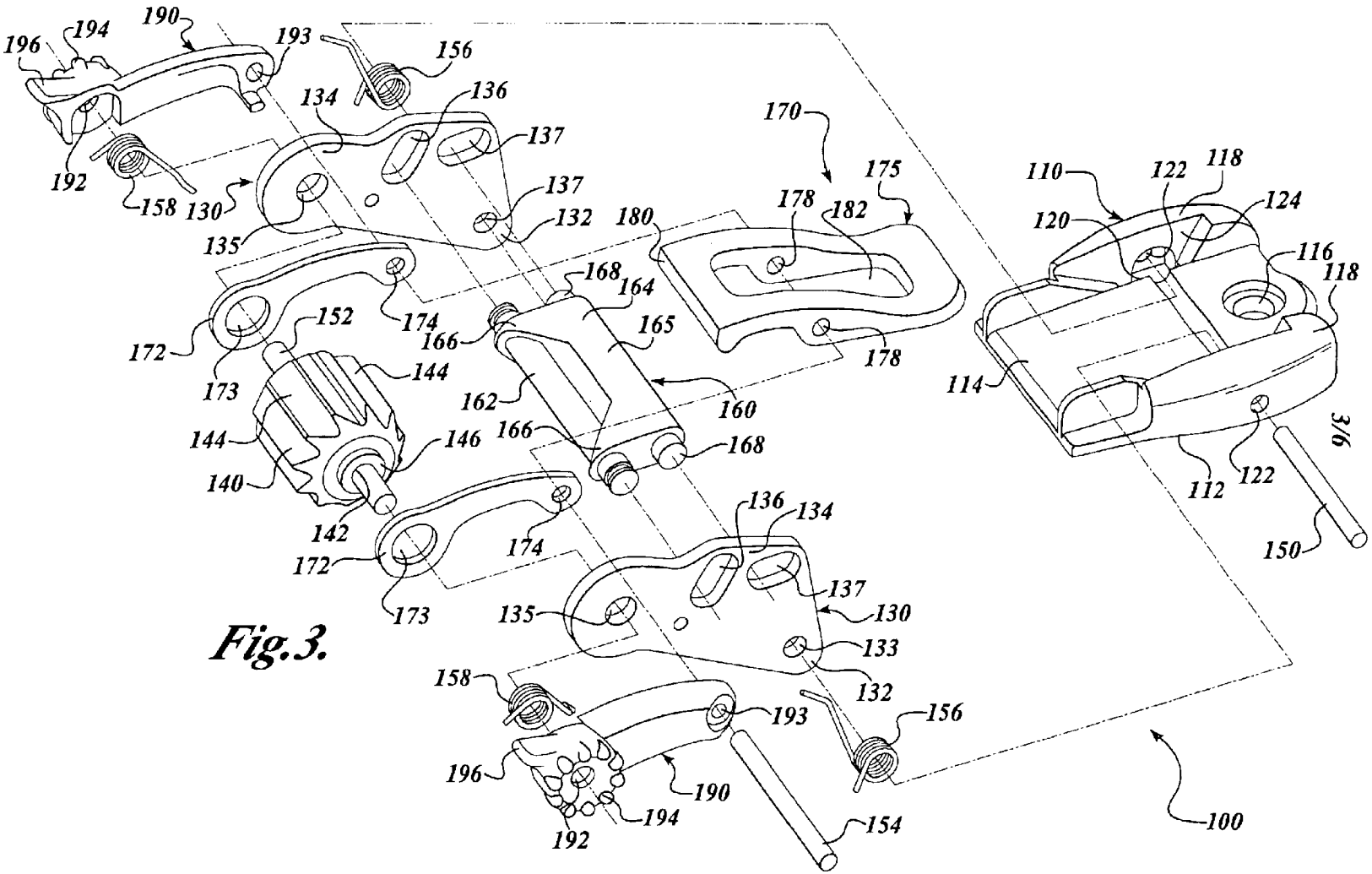
FIG. 3 is an exploded perspective view of the buckle shown in FIG. 1.

A close-up perspective view of the buckle 100 is shown in FIG. 2, and an exploded view of the buckle 100 is shown in FIG. 3. In the disclosed embodiment, the buckle 100 includes a base 110 having a generally planar bottom surface 112 and an upper surface having a longitudinal channel 114 therethrough. (Terms such as "upper," "lower," "vertical," "horizontal," and the like are made with reference to the figures and are not intended to limit the disclosed apparatus, which may be disposed in any convenient orientation.) An attachment aperture 116 is provided through the base 110 to facilitate attachment of the base 110 to a first binding member, such as strap of the instep pad 95. The longitudinal channel 114 is sized to slidably receive a second binding member, such as the toothed strap 80. The longitudinal channel 114 is generally defined by oppositely disposed shoulders 118. A pair of oppositely disposed slots 120 (one shown) are provided through the base 110 at an intermediate longitudinal position, one near each shoulder 118. The slots are beneath indented portions 124 in the interior vertical wall of each shoulder 118. A pair of aligned transverse apertures 122 through each shoulder 118 are provided to facilitate pivotal attachment of sidewalls 130 as described below.

A pair of sidewalls 130, preferably generally flat plates, engage the slots 120 such that the sidewalls 130 extend upwardly from the base 110. Each sidewall 130 has a lower end 132 that is slidably inserted into one of the slots 120 and an upper portion 134 that extends above the shoulders 118 of the base 110, such that each sidewall 130 engages the indented portion 124 of one shoulder 118. Each sidewall 130 includes a base pivot aperture 133 near the lower end 132, that is aligned with the transverse apertures 122 in the base 110 when the sidewalls 130 are inserted into the slots 120. A base pivot pin 150, which may comprise, for example, a rivet, a metal dowel, or a threaded attachment hardware, is inserted through the aligned transverse apertures 122 and base pivot apertures 133 to pivotally connect the sidewalls 130 to the base 110. In the preferred embodiment, the indented portions 124 in the shoulders 118 are sized and oriented to permit the sidewalls 130 to pivot through an angle of approximately 30 degrees.

The upper portion 134 of the sidewalls 130 include generally aligned barrel mounting apertures 135 and first and second aligned holding pawl apertures 136, 137, respectively. The first and second holding pawl apertures 136, 137 are preferably elongate, with the first pawl apertures 136 oriented generally diagonally with respect to the base 110, and the second pawl apertures 137 aligned generally parallel to the base 110.

A toothed barrel 140 having an axial aperture 142 is rotatably mounted between the sidewalls 130 with a barrel pivot pin 152 disposed through the barrel mounting apertures 135 and the barrel axial aperture 142. The barrel 140 includes a plurality of longitudinally teeth 144 that extends outwardly. The barrel teeth 144 are sized and spaced to engage the transverse teeth 85 of strap 80. In a preferred embodiment, the barrel teeth 144 are tapered in a saw-tooth shape, and oriented with a circumferential bias to improve the barrel's ability to positively engage the strap teeth 85 when the barrel is rotated in the forward driving direction, as discussed below. In the embodiment shown in FIGS. 2 and 3, the barrel 140 includes concentric annular axial projections 146 at each end (one shown), to facilitate attachment of a ratchet lever 170, as shown in the FIGURES and described below. It will be appreciated that annular bushings could be utilized rather than axial projections 146. It should also be apparent that the barrel 140, pivot pin 152, and projections 146 may be integrally formed.

A two-piece holding pawl 160 is mounted between the sidewalls 130. A pawl shaft 162 is slidably positioned in the first holding pawl apertures 136, wherein the pawl shaft 162 can slide between an upper position and a lower position within the apertures 136. A pawl adapter 164 having an elongate portion 165 and a pair of forwardly disposed annular portions 166 slidably receives the pawl shaft 162. The pawl adapter 164 includes opposing protrusions 168 that extend into the second holding pawl apertures 137, wherein the pawl adapter 164 can slide between a forward position and a rearward position. The opposing protrusions 168 are aligned on an axis that is parallel to and spaced from a central axis of the pawl shaft 162. The protrusions 168 may be defined by the ends of a shaft secured within the elongate portion 165. The barrel 140 and holding pawl 160 are positioned such that when the holding pawl shaft 162 is in the lower position, the pawl shaft 162 is disposed between adjacent teeth 144 on the barrel 140, thereby interfering with rotation of the barrel 140. When the pawl shaft 162 is in the upper position it is disposed outside the outer diameter of the barrel teeth 144, permitting the barrel 140 to rotate. While described herein as having a two-piece construction, the pawl 160 may alternatively be integrally formed.

It will be appreciated from examining FIGS. 2 and 3, that when the barrel 140 is rotated forwardly (counterclockwise in FIGS. 2 and 3), corresponding to tightening the strap 80 (see, FIGS. 4A–4G), the barrel teeth 144 push the pawl shaft 162 upwardly in the first holding pawl apertures 136, thereby permitting the barrel 140 to rotate. When the barrel 140 is biased to rotate rearwardly (clockwise in FIGS. 2 and 3), for example, by tension in the strap 80, the barrel teeth 144 push generally downwardly on the pawl shaft 162, thereby preventing the barrel 140 from rotating.

In the preferred embodiment, a pair of torsional springs 156 biases the pawl shaft 162 towards the lower position. It will be appreciated that the holding pawl shaft 162 is disposed forwardly of the sidewall pivot pin 150, and therefore the torsional springs 156 also bias the sidewalls 130 downwardly (counterclockwise in FIGS. 2 and 3).

A lever assembly 170 is pivotally mounted to the sidewalls 130, pivotable about the axis of the barrel 140. The lever assembly 170 includes a pair of link members 172 disposed on opposite sides of the barrel 140 and a lever body 175. Each link member 172 has a forward aperture 173 that slidably engages one of the axial projections 146 of the barrel 140, such that the link members 172 are pivotable with respect to the barrel 140. The link members 172 also have aligned rearward apertures 174 that facilitate attachment of the lever body 175. The lever body 175 is an elongate member sized to fit snugly between the rearward portions of the link members 172. The lever body 175 includes a pair of aligned transverse apertures 178 at an intermediate location. A lever pivot pin 154 is inserted through the rearward apertures 174 of the link members 172 and through the lever body transverse aperture 178 to pivotally link the lever body 175 to the link members 172.

The lever body 175 is pivotable between an engaged position wherein the forward end 180 of the lever body engages the teeth 144 of the barrel 140, and a return position wherein the forward end 180 of the lever body 175 is slidable over the barrel teeth 144. In the engaged position, the forward end 180 of the lever body 175 functions as a driving pawl for the barrel 140. An internal biasing mechanism, such as a torsional spring (not shown), biases the lever body 175 towards the engaged position. In the disclosed embodiment, the lever body 175 includes a large, rectangular cutout 182, which lightens the lever, reduces the amount of material required, and provides access to the area underneath the lever body 175.

A pair of end caps 190 are disposed generally overlying the link members 172. Each end cap 190 includes a forward aperture 192 that slidably engages the barrel pivot pin 152, and a rearward aperture 193 that slidably engages the lever pivot pin 154, whereby the end caps 190 pivot with the link members 172. The forward end of the end caps 190 include an enlarged, knurled portion 194 and a release tab 196. The knurled portions 194 and release tabs 196 function to facilitate gripping the buckle. The purpose of the pivotable connection between the base 110 and the sidewalls 130 will now be appreciated, from examining FIGS. 2 and 3. A strap 80 (see, FIG. 5) engaged by the buckle 100 can be released in a single intuitive motion by the grasping the buckle 100, for example, at the end cap release tabs 196, and lifting upwardly, thereby pivoting the sidewalls 130 such that the barrel teeth 144 are lifted away from the strap teeth 85, and pulling the buckle 100 away from the strap 80.

In the preferred embodiment, a second set of torsional springs 158 coils about the outer portion of the barrel pivot pin 152, and connects between the sidewalls 130 and the end caps 190 to bias the entire lever assembly 170 downwardly (clockwise in FIGS. 2 and 3) to the closed position shown in FIG. 2.

The buckle of the present invention can be fabricated from any suitably sturdy material, including, without limitation, hard polymers, nylon, and metal. In a preferred embodiment, the barrel 140 and lever body 175 are made from extruded aluminum, and the link members 172, sidewalls 130, base 110, and pawl shaft 162 are made from a metal, such as aluminum or steel, to produce a very sturdy and reliable ratchet buckle mechanism. The end caps 190 and pawl adapter 164 are made from a nylon or hard polymer material.

Figure 4A:
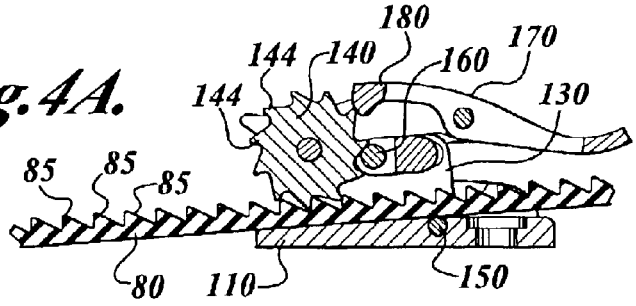
FIGS. 4A–4F show a side view depicting the operation of the buckle shown in FIG. 1.
Figure 4B:
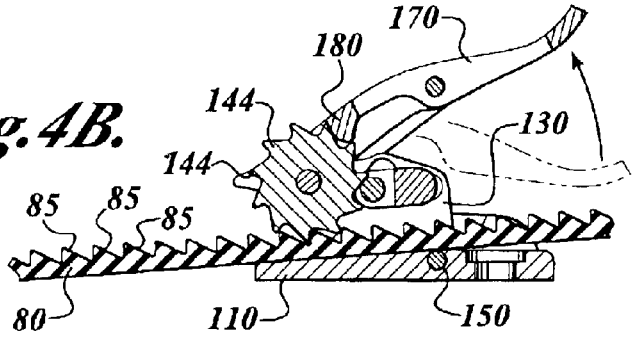
Figure 4C:
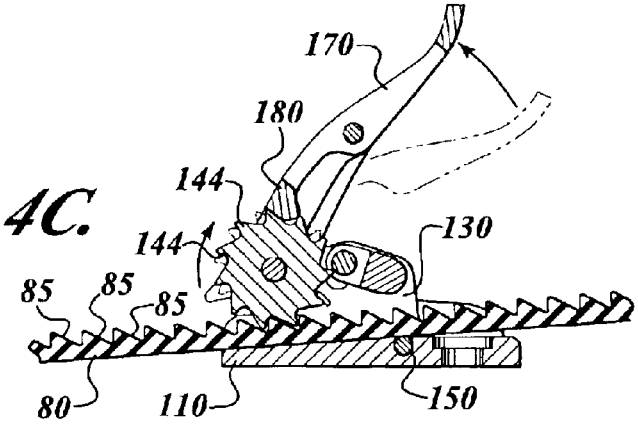
Figure 4D:
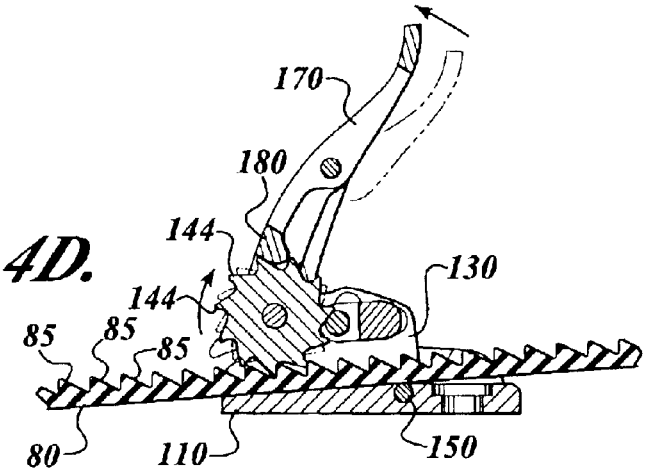
Figure 4E:
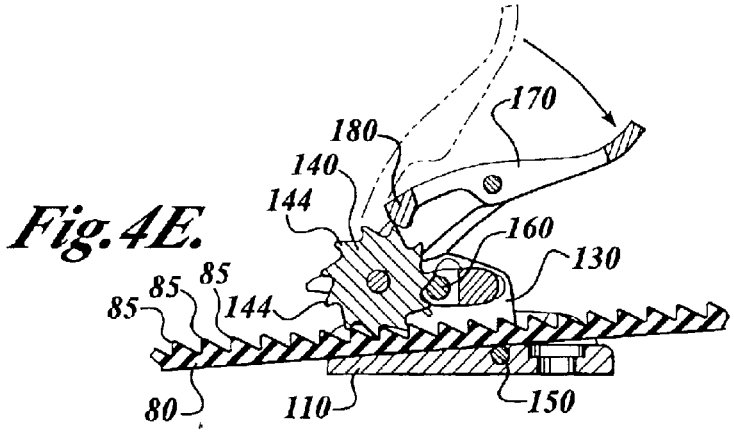
Figure 4F:
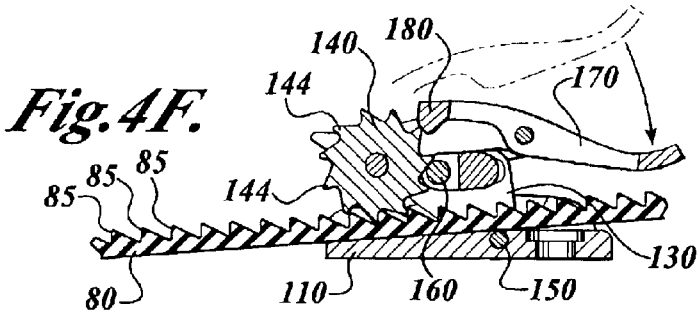

The operation of the buckle 100 is shown in FIGS. 4A–4F, which show a cross-sectional side view taken through the buckle longitudinal centerline. As shown in FIG. 4A, a ladder strap 80 having a plurality of transverse teeth 85 is inserted into the buckle 100 beneath the barrel 140. The buckle 100 is attached to a first binding member, such as an instep pad 95 (as shown in FIG. 1). The ladder strap 80 has sufficient rigidity to be pushed under the barrel 140, either by causing the side plates 130 to pivot about the pivot pin 150, or by rotating the barrel 140 counterclockwise, such that the holding pawl 160 slides upwardly. The lever assembly 170 is then rotated upwardly (counterclockwise) as shown in FIG. 4B until the forward end 180 engages a tooth 144 of the barrel 140. Further rotation of the lever assembly 170 (FIG. 4C) causes the barrel 140 to rotate, thereby tightening the strap 80. It will be appreciated that the holding pawl 160 is pushed upwardly and out of the way by the barrel teeth 144. In the preferred embodiment, the lever assembly 170 can rotate the barrel 140 over several teeth 144 in a single forward sweep (FIG. 4D). The lever assembly 170 is then rotated counterclockwise to return to the closed position (FIGS. 4E and 4F). It will be appreciated that during the return stroke, the holding pawl 160 is in the lower position thereby preventing the barrel 140 from rotating in the clockwise direction. Although tension in the strap 80 will produce a torque on the barrel 140, the barrel tooth engaging the holding pawl 160 biases the holding pawl downwardly into the locked lower position. The lever body 175, however, is pivotally connected to the link members 172, whereby the forward end 180 pivots away from the barrel 140 to return to the closed position. The user can then repeat the tightening stroke until the desired strap tension is achieved and then return the lever assembly 170 to the closed position (FIG. 4F). In particular, it is noted that the strap 80 applies a sideways force on the buckle 100, but does not produce an upward force that would tend to push the barrel 140 away from the base 110.

Figure 5:
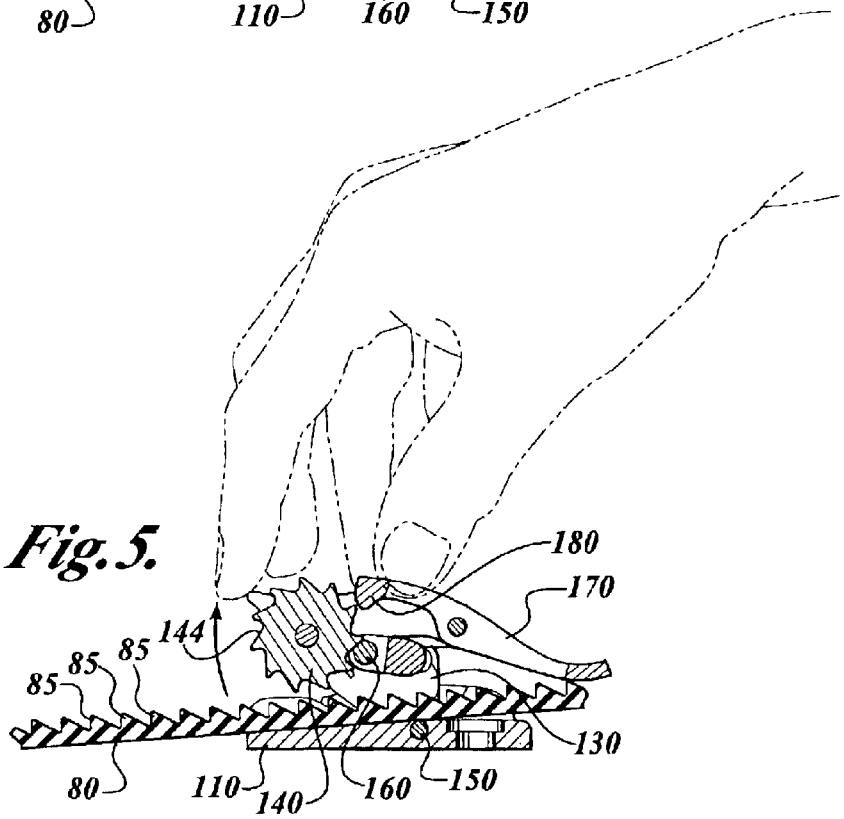
FIG. 5 shows a side view depicting the buckle shown in FIG. 1 lifted away from the strap to release the strap.

When the user desires to release the strap 80 from the buckle 100, the user merely grasps the upper portion of the buckle, for example, the release tabs 196, and pulls the barrel 140 away from the strap 80, as shown in FIG. 5. This disengages the barrel teeth 144 from the strap teeth 85, releasing the strap.

Figure 6:
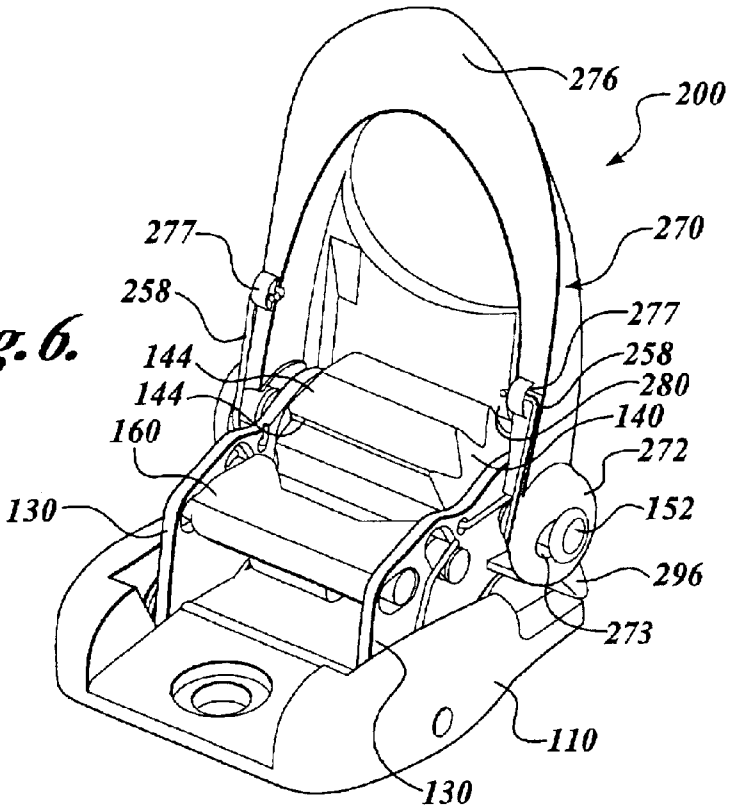
FIG. 6 shows a perspective view of a second embodiment of a buckle in accordance with the present invention, having a one-piece lever including an integral driving pawl.

Another embodiment of a buckle according to the present invention is shown in FIG. 6, which shows a buckle 200 having a one-piece lever 270. The base 110, sidewalls 130, toothed barrel 140, and holding pawl 160 are generally the same as that described above. The lever 270 is preferably of unitary construction, having a proximal end 272 having oppositely disposed elongate transverse apertures 273 (one shown) that rotatably engage the barrel pivot pin 152. Release tabs 296 disposed at the proximal end 272 facilitate gripping of the lever 270 for releasing the strap, similar to the first embodiment described above. The elongate apertures 273 permit the lever proximal end 272 to be slidably moved between a first (lower) position and an second (upper) position (the lever 270 is shown in the first position in FIG. 6). The lever 270 includes a center pawl portion 280 that is located such that when the lever proximal end 272 is in the first position, the pawl portion 280 engages the barrel teeth 144; and when the lever 270 is in the second position, the pawl portion 280 is disposed outwardly of the barrel teeth 144, thereby releasing the barrel 140. The distal portion 276 of the lever 270 is adapted to be engaged by the user, to rotate the lever 270 about the barrel pivot pin 152.

It will be appreciated from FIG. 6 that as the distal portion 276 of the lever 270 is rotated upwardly with the proximal end 272 in the first position, the pawl portion 280 will engage the toothed barrel 140, rotating the barrel 140 and thereby tightening the strap, as in the previous embodiment. Moreover, because the pawl portion 280 is intermediate of the distal portion 276 and the proximal end 272 of the lever 270, the proximal end 272 will be biased towards the first position by the upward force on the distal portion 276, thereby maintaining the pawl portion 280 in engagement with the barrel 140. When the lever 270 is pivoted in the opposite direction, the holding pawl 160 engages the toothed barrel 140 (as discussed above for buckle 100), preventing it from rotating. The proximal end 272 of the lever 270 is biased towards the second position by the force applied to the distal end 276, thereby permitting the lever to return to the closed position without rotating the barrel 140.

It will be appreciated that, as in the previous embodiment, the toothed barrel 140 can be lifted away from the base 110, pivoting the sidewalls 130 and releasing the strap 80. Biasing members such as torsional springs 258 are provided to bias the lever towards the closed position. The lever 250 includes two spring retainer apertures 277 that are disposed in the distal portion 276, whereby the retainer springs 258 do not prevent lifting the lever 270 away from the base 110.

An advantage of this second embodiment buckle 200 is that by utilizing, for example, an appropriate polymeric material for the lever 270 and a suitably deformable geometry, the pawl portion 280 can be designed to deformably accommodate the barrel teeth 144 at a selectable design applied force, thereby limiting the amount of stress that can be applied by the user to the strap 80, thereby preventing or reducing the likelihood of damage to the buckle and/or strap.

Figure 7:
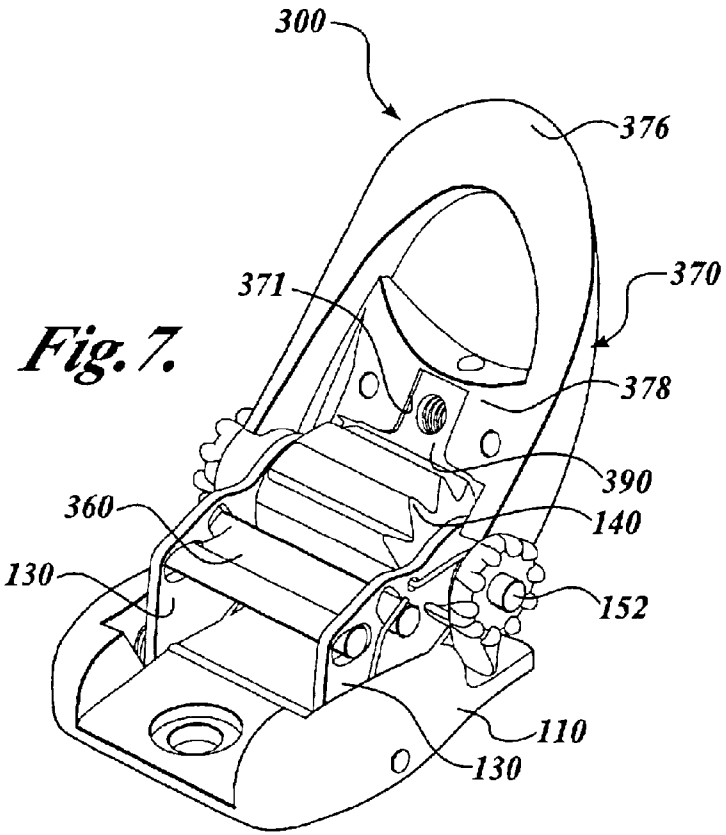
FIG. 7 shows a perspective view of a third embodiment of a buckle in accordance with the present invention, having a spring-biased pawl built into the lever.

A third embodiment of a buckle according to the present invention is shown in FIG. 7, which shows a buckle 300 having a base 110, sidewalls 130, and toothed barrel 140 substantially the same as described above. The holding pawl 360 is also similar to the holding pawl 160 described above, and functions in substantially the same manner. The holding pawl 360, however, is unitary in construction, which may be less expensive to manufacture and assembly.

In this third embodiment, a lever assembly 370 includes a lever body 375 having a proximal end 372 with oppositely disposed transverse apertures 373 that pivotally engage the barrel pivot pin 152. The lever body 375 includes a distal portion 376 and a central portion 378. The central portion 378 includes a cavity 371 disposed generally adjacent the barrel 140. A driving pawl member 390 is slidably and springedly captured within the rectangular cavity 371, the driving pawl member 390 being elastically biased towards the barrel 140, and positioned such that the driving pawl member 390 engages the barrel teeth 144. In the preferred embodiment, a coil spring (not shown) is disposed within the cavity 371 behind the driving pawl member 390, thereby biasing the driving pawl member 390 outwardly.

It will now be appreciated that by rotating the lever assembly 370 upwardly (clockwise in FIG. 7) the driving pawl member 390 engages the barrel 140, thereby rotating the barrel 140 and tightening the strap (not shown), as in the previous embodiments. On the return stroke (counterclockwise in FIG. 7) the locking pawl 360 prevents the barrel 140 from rotating, and the driving pawl 390 is elastically pushed out of the way as the lever assembly 370 returns to the closed position. The user can therefore tighten the strap to the desired tension, and release the strap, as in the previous embodiments, by lifting the upper portion of the buckle 300 away from the base.

While the buckle of the present invention has been described with reference to a strap on a snowboard binding, it would be apparent that it is also suitable for use with other types of sporting goods, such as strap carried on step-in binding type snowboard boots, snowshoes, and in-line skates.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A ratchet-type buckle for use with an elongate strap having a plurality of transverse engagement elements, the buckle comprising:

a channel adapted to receive the strap;

at least one wall extending distally from the channel;

a barrel having a central axis and rotatably mounted to the at least one wall, wherein the barrel includes a plurality of outwardly disposed teeth parallel to the barrel axis that are spaced to drivably engage the transverse engagement elements, the barrel being movable between a first position wherein the barrel teeth are disposed to engage the strap, and a second position wherein the barrel teeth are disposed to release the strap;

a holding pawl mounted to the at least one wall, the holding pawl positioned to permit rotation of the barrel in a forward direction and to interfere with rotation of the barrel in the direction opposite the forward direction;

a lever pivotally mounted to the at least one wall, the lever member including a driving pawl that is adapted to drivably engage the barrel for rotation in the forward direction and to slidably accommodate the barrel without rotating the barrel in the direction opposite the forward direction; and further comprising a base member that defines the channel and wherein the at least one wall comprises a pair of oppositely disposed sidewalls that are pivotally attached to the base member such that movement of the barrel from the first position to the second position is accommodated by pivoting the sidewalls.

2. The buckle of claim 1, wherein the lever comprises left and right link members, each link member having a proximal end and a distal end, the proximal end being pivotally attached to the barrel such that the link members are pivotable about the barrel axis, the lever further comprising a lever body pivotally attached between the distal ends of the link members, wherein the forward portion of the lever body comprises the driving pawl.

3. The buckle of claim 2, further comprising left and right end caps that are coupled to the lever, the end caps being adapted to pivot with the lever.

4. A ratchet-type buckle for engaging an elongate strap having a plurality of transverse teeth, the buckle comprising:

a base portion having an upper surface adapted to receive the strap;

a pair of oppositely disposed sidewalls extending upwardly from the base portion;

a strap engagement member rotatably mounted between the pair of sidewalls, wherein the strap engagement member includes a plurality of outwardly disposed teeth that is adapted to drivably engage the strap teeth, the strap engagement member being movable between a first position, wherein the strap engagement member teeth are disposed to engage the strap teeth, and a second position, wherein the strap engagement member teeth are disposed releasable above the strap teeth;

a holding pawl mounted between the pair of sidewalls, the holding pawl adapted to permit rotation of the strap engagement member in a forward direction and to interfere with rotation of the strap engagement member in the direction opposite the forward direction; and a lever assembly pivotally mounted to the pair of sidewalls, the lever assembly including a driving pawl that is adapted to drivably engage the strap engagement member for rotation in the forward direction and to slidably accommodate the strap engagement member in the direction opposite the forward direction;

wherein the sidewalls are pivotally attached to the base portion such that movement of the strap engagement member from the first position to the second position is accommodated by pivoting the sidewalls.

5. The buckle of claim 4, further comprising at least one biasing member that biases the strap engagement member towards the first position.

6. The buckle of claim 5, wherein the sidewalls can pivot through an angle of about thirty degrees.

7. The buckle of claim 4, wherein the strap engagement member includes a toothed barrel rotatable about its axis, and further, wherein the lever assembly comprises left and right link members, each link member having a proximal end and a distal end, the proximal end being pivotally attached to the barrel such that the link members are pivotable about the barrel axis, the lever assembly further comprising a lever body pivotally attached between the distal ends of the link members wherein the forward portion of the lever body comprises the driving pawl.

8. The buckle of claim 7, further comprising transverse release tabs defined on opposite sides of the lever assembly for disengagement of the strap engagement member from the strap.

9. The buckle of claim 8, further comprising left and right end caps that are coupled to the lever assembly, the end caps being adapted to pivot with the lever assembly.

10. The buckle of claim 8, wherein the transverse release tabs project from the left and right end caps.

11. The buckle of claim 7, wherein the lever assembly comprises a unitary lever body pivotal about the axis of the barrel, the lever assembly further comprising a driving pawl member that is springedly attached to the lever body.

12. A ratchet-type buckle for use with an elongate strap having a plurality of transverse teeth, the buckle comprising:

a channel adapted to receive the strap;

a pair of oppositely disposed sidewalls extending upwardly from the channel;

a barrel having a central axis and rotatably mounted between the pair of sidewalls, wherein the barrel includes a plurality of outwardly disposed teeth that are spaced to drivably engage the strap teeth, the barrel being movable between a first position wherein the barrel teeth are disposed to engage the strap teeth, and a second position wherein the barrel teeth are disposed to release the stray teeth;

a holding pawl mounted between the pair of sidewalls, the holding pawl positioned to permit rotation of the barrel in a forward direction and to interfere with rotation of the barrel in the direction opposite the forward direction; and a lever pivotally mounted between the pair of sidewalls, the lever including a driving pawl that is adapted to drivably engage the toothed barrel for rotation in the forward direction and to slidably accommodate the barrel without rotating the barrel in the direction opposite the forward direction;

wherein the sidewalls are pivotable with respect to the channel such that the toothed barrel is movable between the first position and the second position by pivoting the sidewalls.

13. The buckle of claim 12, further comprising at least one biasing member that biases the barrel towards the first position.

14. The buckle of claim 13, wherein the sidewalls can pivot through an angle of about thirty degrees.

15. A ratchet-type buckle for use with an elongate strap having a plurality of transverse teeth, the buckle comprising:

a channel adapted to receive the strap;

a pair of oppositely disposed sidewalls extending upwardly from the channel;

a barrel having a central axis and rotatably mounted between the pair of sidewalls, wherein the barrel includes a plurality of outwardly disposed teeth that are spaced to drivably engage the strap teeth, the barrel being movable between a first position wherein the barrel teeth are disposed to engage the strap teeth, and a second position wherein the barrel teeth are disposed to release the strap teeth;

a holding pawl mounted between the pair of sidewalls, the holding pawl positioned to permit rotation of the barrel in a forward direction and to interfere with rotation of the barrel in the direction opposite the forward direction; and a lever pivotally mounted between the pair of sidewalls, the lever including a driving pawl that is adapted to drivably engage the toothed barrel for rotation in the forward direction and to slidably accommodate the barrel without rotating the barrel in the direction opposite the forward direction; and further comprising opposed annular elements disposed coaxially with the barrel, and wherein the lever comprises left and right link members, each link member having a proximal end with a circular aperture that slidably engages one of the annular elements such that the link members are pivotable about the barrel axis, the lever further comprising a lever body pivotally attached between the link members wherein the forward portion of the lever body comprises the driving pawl.

16. The buckle of claim 15, further comprising transverse release tabs defined on opposite sides of the lever for lifting and disengagement of the strap engagement member from the strap.

17. The buckle of claim 16, further comprising left and right end caps that are coupled to the lever, the end caps being adapted to pivot with the lever.

18. The buckle of claim 17, wherein the transverse release tabs project from the left and right end caps.

* * * * *

UNITED STATES PATENT AND TRADEMARK OFFICE

CERTIFICATE OF CORRECTION

PATENT NO. : 6,748,630 B2
DATED : June 15, 2004
INVENTOR(S) : D. Livingston

It is certified that error appears in the above-identified patent and that said Letters Patent is hereby corrected as shown below:

Column 10,
Line 15, "claim 8," should read -- claim 9, --

Signed and Sealed this

Seventh Day of December, 2004

JON W. DUDAS
*Director of the United States Patent and Trademark Office*